US011946342B2

(12) United States Patent
Lu et al.

(10) Patent No.: US 11,946,342 B2
(45) Date of Patent: Apr. 2, 2024

(54) DRILLING TOOL

(71) Applicants: CHINA PETROLEUM & CHEMICAL CORPORATION, Beijing (CN); SINOPEC PETROLEUM ENGINEERING TECHNOLOGY RESEARCH INSTITUTE CO., LTD., Beijing (CN)

(72) Inventors: Baoping Lu, Beijing (CN); Haiping Zhang, Beijing (CN); Mingguang Sun, Beijing (CN); Jiachang Wang, Beijing (CN); Yanbin Zang, Beijing (CN); Xinghua Tao, Beijing (CN); Lingchao Xuan, Beijing (CN); Xiaodan Liu, Beijing (CN); Renlong Zhang, Beijing (CN); Lishuang Wang, Beijing (CN)

(73) Assignees: China Petroleum & Chemical Corporation, Beijing (CN); Sinopec Petroleum Engineering Technology Research Institute Co., Ltd., Beijing (CN)

( * ) Notice: Subject to any disclaimer, the term of this patent is extended or adjusted under 35 U.S.C. 154(b) by 127 days.

(21) Appl. No.: 17/757,125

(22) PCT Filed: Sep. 11, 2020

(86) PCT No.: PCT/CN2020/114860
§ 371 (c)(1),
(2) Date: Jun. 9, 2022

(87) PCT Pub. No.: WO2021/120722
PCT Pub. Date: Jun. 24, 2021

(65) Prior Publication Data

US 2022/0412165 A1 Dec. 29, 2022

(30) Foreign Application Priority Data

Dec. 16, 2019 (CN) ..... 201911295604.2

(51) Int. Cl.
*E21B 4/14* (2006.01)
*E21B 4/10* (2006.01)
*E21B 4/00* (2006.01)

(52) U.S. Cl.
CPC ..... *E21B 4/14* (2013.01); *E21B 4/10* (2013.01); *E21B 4/003* (2013.01)

(58) Field of Classification Search
CPC . E21B 31/107; E21B 4/10; E21B 4/14; E21B 4/003
See application file for complete search history.

(56) References Cited

U.S. PATENT DOCUMENTS 1,901,513 A * 3/1933 Harris ..... E21B 31/107 175/298
2,613,917 A * 10/1952 Postlewaite ..... E21B 4/10 175/298

(Continued)

FOREIGN PATENT DOCUMENTS

CN 103967408 A 8/2014
CN 204060517 U 12/2014

(Continued)

OTHER PUBLICATIONS

CN 106639866, English Translation, 7 pages (Year: 2018).*

*Primary Examiner* — Jennifer H Gay
(74) *Attorney, Agent, or Firm* — NKL Law; Allen Xue

(57) ABSTRACT

A drilling tool includes an outer cylinder; a power rotary shaft arranged in an inner chamber of the outer cylinder; a percussion generator arranged below the power rotary shaft, having a transmission shaft extending in the outer cylinder and can be driven by the power rotary shaft to rotate around its axis, an output main shaft engaged with a lower end of the transmission shaft so as to be driven by the transmission shaft to rotate about its axis and is movable relative to the transmission shaft along an axial direction, and an percus- (Continued)

sion assembly The percussion assembly is arranged between an annulus formed between the upper end of the output main shaft and the outer cylinder and can generate reciprocating impact along the axial direction on the output main shaft. A drilling bit connected with the output main shaft extending out of the inner chamber of the outer cylinder.

18 Claims, 5 Drawing Sheets

(56) References Cited

U.S. PATENT DOCUMENTS

| | | | | |
|---|---|---|---|---|
| 3,396,807 | A * | 8/1968 | Menton | E21B 4/10 175/298 |
| 4,047,581 | A | 9/1977 | Erickson | |
| 7,445,061 | B1 * | 11/2008 | Falgout, Sr. | E21B 4/003 175/106 |
| 9,644,440 | B2 * | 5/2017 | Kerstetter | E21B 4/10 |
| 11,441,380 | B2 * | 9/2022 | Moyes | E21B 31/1135 |
| 2004/0089461 | A1 * | 5/2004 | Cioceanu | E21B 4/10 173/90 |
| 2005/0173157 | A1 | 8/2005 | Ravensbergen et al. | |
| 2011/0180329 | A1 | 7/2011 | Rambo | |
| 2015/0107904 | A1 * | 4/2015 | Kerstetter | E21B 17/03 175/57 |
| 2015/0376950 | A1 | 12/2015 | Su | |
| 2017/0152720 | A1 | 6/2017 | Greenwood et al. | |
| 2020/0340321 | A1 * | 10/2020 | Moyes | E21B 31/005 |
| 2022/0412165 | A1 * | 12/2022 | Lu | E21B 4/10 |
| 2022/0412167 | A1 * | 12/2022 | McCullough | E21B 17/10 |
| 2023/0003084 | A1 * | 1/2023 | Zhang | E21B 4/16 |

FOREIGN PATENT DOCUMENTS

| | | | | |
|---|---|---|---|---|
| CN | 204941340 | U | 1/2016 | |
| CN | 105421996 | A | 3/2016 | |
| CN | 206129207 | U | 4/2017 | |
| CN | 106639859 | A | 5/2017 | |
| CN | 106639864 | A | 5/2017 | |
| CN | 106639866 | A | 5/2017 | |
| CN | 106639943 | A * | 5/2017 | E21B 28/00 |
| CN | 107120062 | A | 9/2017 | |
| CN | 107503678 | A | 12/2017 | |
| CN | 107514229 | A | 12/2017 | |
| CN | 107514233 | A | 12/2017 | |
| CN | 206769795 | U | 12/2017 | |
| CN | 108915583 | A | 11/2018 | |

* cited by examiner

DRILLING TOOL

CROSS REFERENCE OF RELATED APPLICATION

This application is a U.S. National stage entry of PCT International Application No. PCT/CN2020/114860, filed on Sep. 11, 2020, which claims the priority of Chinese patent application No. 201911295604.2, entitled "Drilling Tool" and filed on Dec. 16, 2019, the entire content of which is incorporated herein by reference.

TECHNICAL FIELD

The present invention relates to the technical field of oil and gas well drilling, in particular to a drilling tool.

TECHNICAL BACKGROUND

With the developments of land deep/ultra-deep well drilling, deep-water offshore drilling, shale oil/gas exploitation and hot-dry rock geothermal resource exploitation, the fields of energy development and scientific drilling are constantly broadened. The formations encountered in drilling operations are more ancient, causing poor rock drillability.

Most of current drilling tools are rotary drilling tools, which drill out the formations through applying rotation thereon. However, this type of drilling tools has a limited drilling effect. For the above-mentioned formations with poor drillability, the drilling efficiency is low and the drilling bit is easily damaged, so that the drilling cost is very high.

Therefore, there is a need for a drilling tool that can effectively reduce the drilling cost.

SUMMARY OF THE INVENTION

In view of the above problem, the present invention proposes a drilling tool that can effectively reduce the drilling cost.

According to the present invention, a drilling tool is proposed, comprising: an outer cylinder; a power rotary shaft arranged in an inner chamber of the outer cylinder and configured to be driven to rotate around its own axis; a percussion generator arranged below the power rotary shaft, comprising a transmission shaft extending in the outer cylinder and configured to be coupled with and driven by the power rotary shaft to rotate around its axis, an output main shaft, which has an upper end engaged with a lower end of the transmission shaft so as to be driven by the transmission shaft to rotate about its axis and is movable relative to the transmission shaft along an axial direction, and an percussion assembly, which is arranged between an annulus formed between the upper end of the output main shaft and the outer cylinder, and is configured to generate reciprocating impact along the axial direction on the output main shaft; and a drilling bit connected with a lower end of the output main shaft extending out of the inner chamber of the outer cylinder.

With this arrangement, the percussion assembly can generate reciprocating impact along the axial direction on the output main shaft. The impact can be transmitted to the drilling bit, which can impact on the formation. Therefore, the drilling bit can impact on the formation during rotary drilling. This compound action facilitates to break up the formation rapidly, thus increasing drilling efficiency and reducing drilling cost.

In one embodiment, the percussion assembly comprises: a cam anvil fixedly arranged around an outer wall of the output main shaft; a cam hammer arranged around the outer wall of the output main shaft, a lower end of the cam hammer being formed with a driven tooth, which forms a conjugate set of cam teeth with a driving tooth formed on the cam anvil; and an elastic member arranged in an annulus formed between the output main shaft and the outer cylinder and axially located between an upper end face of the cam hammer and a lower end face of the transmission shaft. During rotation of the cam anvil around its axis, the driving tooth acts on the driven tooth to enable the cam hammer to move reciprocally in the axial direction and act on the elastic member, so that the elastic member acts on the cam hammer and the cam anvil in sequence, causing the output main shaft to generate axial reciprocating impact.

In one embodiment, a washer is provided at each axial end of the elastic member, and a plurality of through holes evenly distributed in a circumferential direction is arranged on a first annular line of the washer, the through holes axially passing through the washer.

In one embodiment, the output main shaft and the transmission shaft are connected with each other by splines. A wear-resistant joint is fixedly arranged at the lower end of the outer cylinder, and is in clearance fit with the output main shaft. A retaining ring assembly is arranged around the outer wall of the output main shaft, and located below the cam anvil. The retaining ring assembly is configured to be in engagement with the wear-resistant joint, so as to prevent the cam anvil and the output main shaft from moving further downward relative to the transmission shaft.

In one embodiment, the retaining ring assembly comprises: an upper retaining ring fixedly arranged around the outer wall of the output main shaft and located below the cam anvil; a lower retaining ring arranged around the outer wall of the output main shaft, the lower retaining ring having an upper end face opposite to the upper retaining ring, and forming a locking connection between its inner wall at a lower end thereof and a first step surface arranged on the output main shaft; and balls arranged between opposing surfaces of the upper and lower retaining rings.

In one embodiment, an outer wall of the cam hammer is provided with first spline teeth protruding therefrom, and an inner wall of the outer cylinder is provided with first spline slots engageable with the first spline teeth. A boss protruding radially inward is provided on the inner wall of the outer cylinder below the first spline slots, forming a snap fit with the first spline teeth.

In one embodiment, a turbine power unit for driving the power rotary shaft to rotate around its axis is arranged in the inner chamber of the outer cylinder, and comprises: a turbine assembly disposed in an annulus formed between the power rotary shaft and the outer cylinder, the turbine assembly having a stator fixedly connected to the outer cylinder, and a rotor fixedly connected to the power rotary shaft; and a flow passage hole arranged on the power rotary shaft and passing therethrough. Fluid injected into the annulus formed between the power rotary shaft and the outer cylinder drives the turbine assembly so that the rotor of the turbine assembly drives the power rotary shaft to rotate around its axis, and then passes through the flow passage hole to enter into the inner chamber of the power rotary shaft, and flows downward through the transmission shaft and the output main shaft.

In one embodiment, a nozzle in communication with the power rotary shaft is provided at an upper end of the power rotary shaft, and restricted by a pressing cap fixed on the power rotary shaft. An outer wall of the pressing cap is provided with a cap rim, which abuts against the inner wall of the outer cylinder in a radial direction, and is provided with a flow-regulating hole axially passing through the cap rim.

In one embodiment, a first flow-regulating wear-resistant ring located above the turbine assembly is arranged in the annulus between the power rotary shaft and the outer cylinder, and/or a second flow-regulating wear-resistant ring located below the turbine assembly is arranged in the annulus between the power rotary shaft and the outer cylinder.

In one embodiment, a bearing pack is provided between the outer cylinder and the transmission shaft, an inner ring of the bearing pack being fixed to the transmission shaft and an outer ring thereof being fixed to the outer cylinder.

Compared with the prior arts, the present invention has the advantages as follows. Under the action of the percussion assembly, the output main shaft will be subjected to reciprocating impact along the axial direction. The impact can be transmitted to the drilling bit, which can impact on the formation. This compound action facilitates to break up the formation rapidly, thus increasing drilling efficiency and reducing drilling cost.

BRIEF DESCRIPTION OF THE DRAWINGS

In the following the present invention will be explained in more detail by way of embodiments with reference to the accompanying drawings. In the drawings.

In the drawings, the same reference numerals are used to indicate the same components. The drawings are not drawn to actual scale.

DETAILED DESCRIPTION OF EMBODIMENTS

The present invention will be further described below in conjunction with the accompanying drawings.

Figure 1:
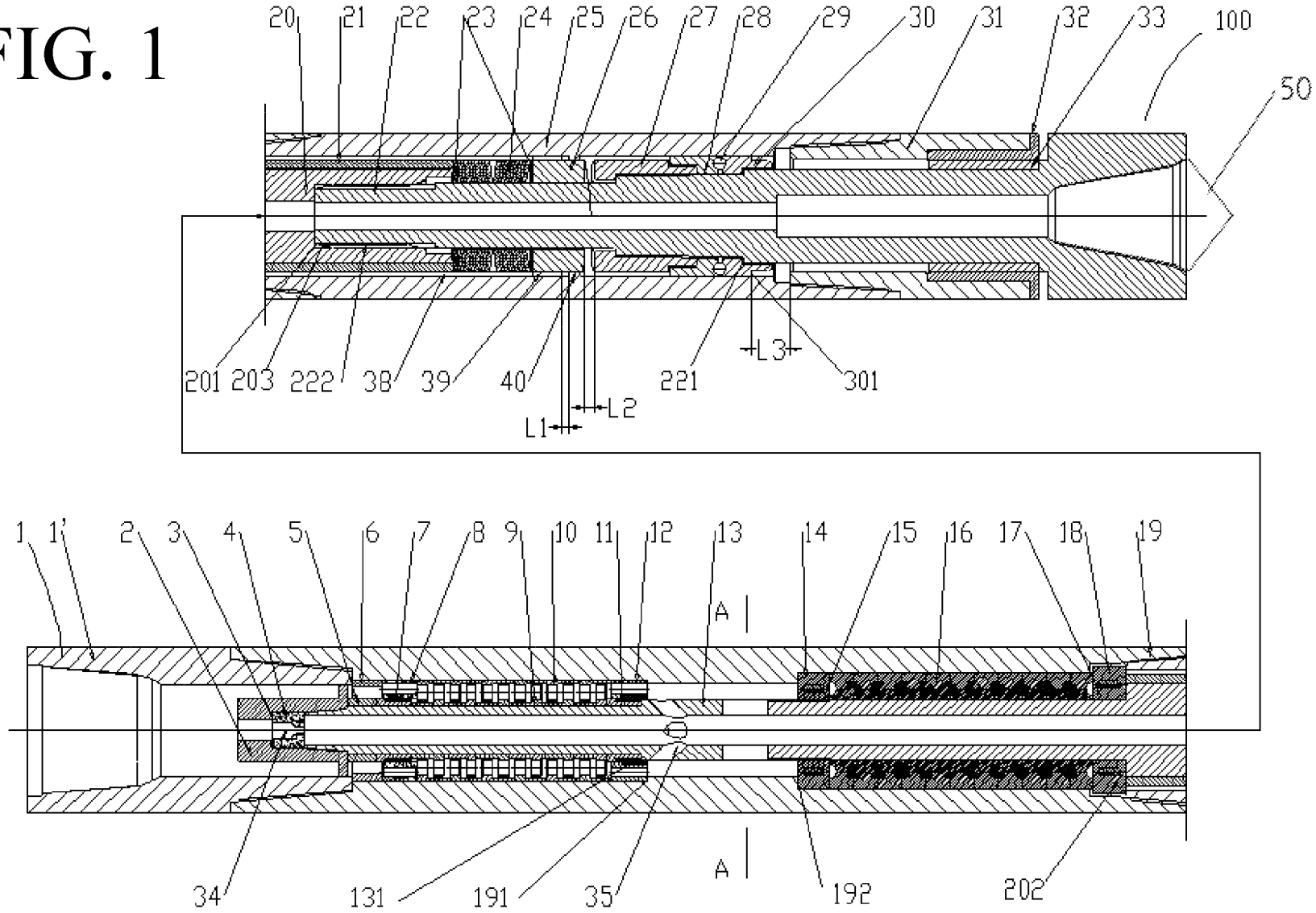
FIG. 1 schematically shows a drilling tool according to one embodiment of the present invention.

FIG. 1 schematically shows an embodiment of a drilling tool 100 according to the present invention. The drilling tool 100 includes an outer cylinder 1, a power rotary shaft 13, a percussion generator, and a drilling bit 50. The outer cylinder 1 has a tubular structure, and mainly functions to connect members and transmit force. The power rotary shaft 13 is arranged in an inner chamber of the outer cylinder 1, and can be driven to rotate around its own axis for transmitting rotary torque and ensuring efficient cutting of the drilling bit 50. The percussion generator is arranged below the power rotary shaft 13, for providing percussive energy to the (billing bit 50. Therefore, the drilling bit 50 of the drilling tool 100 of the present invention can impact on the formation while performing rotary drilling operations. This compound action facilitates to break up the formation rapidly, thus increasing drilling efficiency and reducing drilling cost.

Figure 4:
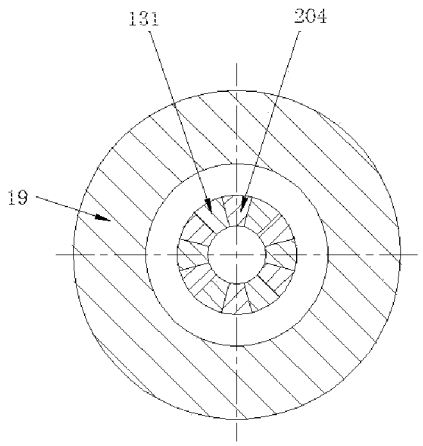
FIG. 4 shows a cross-sectional view of the drilling tool of FIG. 1 along line A-A.

In one embodiment, the percussion generator has a transmission shaft 20, an output main shaft 22, and a percussion assembly. As shown in FIG. 1, the transmission shaft 20 per se is cylindrical, and extends in the inner chamber of the outer cylinder 1. An upper end of the transmission shaft 20 is coupled with the power rotary shaft 13, so that the transmission shaft 20 can be driven by the power rotary shaft 13 to rotate around its own axis. Preferably, as shown in FIG. 4, the power rotary shaft 13 and the transmission shaft 20 are connected with each other through keys. Specifically, a plurality of first orienting keys 131 extending in an axial direction is arranged on a lower end face of the power rotary shaft 13, and a plurality of second orienting keys 204 extending in the axial direction is arranged on an upper end face of the transmission shaft 20. Each of the first orienting keys 131 can axially extend into a space formed by two adjacent second orienting keys 204, thus forming a circumferential locking connection. In this manner, the transmission shaft 20 can move axially relative to the power rotary shaft 13, but not rotate relative thereto. This connection ensures good torque transmission with a simple structure.

In particular, an upper end of the output main shaft 22 is coupled with a lower end of the transmission shaft 20, so that the output main shaft 22 can be driven by the transmission shaft 20 to rotate about its axis. For example, an axially extending mounting recess 201 is formed at the lower end of the transmission shaft 20. The upper end of the output main shaft 22 can be inserted axially upward into the mounting recess 201. Moreover, a spline structure is arranged between an inner wall of the mounting recess 201 and an outer wall of the output main shaft 22, for ensuring that the output main shaft 22 can rotate together with the transmission shaft 20. This arrangement can further enable the output main shaft 22 to move axially relative to the transmission shaft 20. Preferably, the spline structure includes axially extending spline slots 203, which are arranged on the inner wall of the mounting recess 201, and each provided at an inlet thereof with a chamfer of, e.g., 12-18 degrees, Δt the same time, the spline structure further includes spline teeth 222, which are arranged on the outer wall of the output main shaft 22, and each provided at an inlet thereof with a chamfer corresponding to the spline slot 203, thus facilitating a plug-in connection between the output main shaft 22 and the transmission shaft 20. In addition, a stress relief groove is provided at a root of each of the spline slots 203.

Figure 7:
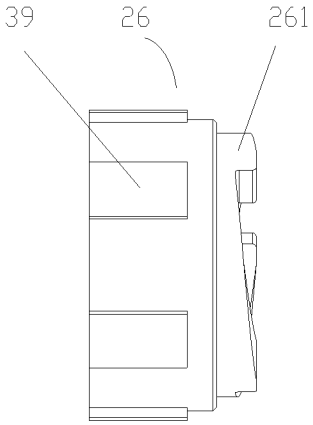
FIG. 7 shows an embodiment of a cam hammer of the drilling tool of FIG. 1.
Figure 8:
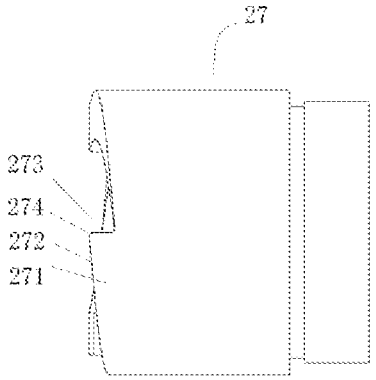
FIG. 8 shows an embodiment of a cam anvil of the drilling tool of FIG. 1.

The percussion assembly is located between an annulus formed by the upper end of the output main shaft 22 and the outer cylinder 1, and configured to generate reciprocating impact on the output main shaft 22 in the axial direction. In one embodiment, the percussion assembly includes a cam anvil 27, a cam hammer 26, and an elastic member 24. As shown in FIG. 8, the cam anvil 27 per se is cylindrical, and is fixedly arranged around the outer wall of the output main shaft 22. For example, the cam anvil 27 can be fixed on the output main shaft 22 by means of threads. The outer wall of the output main shaft 22 and the inner wall of the cam anvil 27 are respectively provided with limiting step faces, which can cooperate with each other for positioning the cam anvil 27 and providing a platform for force transmission. A driving tooth 271 is formed on an upper end face of the cam anvil 27. As shown in FIG. 7, the cam hammer 26 per se is also cylindrical, and arranged around the outer wall of the output main shaft 22 with a gap formed therebetween. The cam hammer 26 is located above the cam anvil 27. A driven tooth 261 is provided on a lower end face of the cam hammer 26, and can cooperate with the driving tooth 271 to form a conjugate set of cam teeth. For example, the driving tooth 271 has a plurality of curved surfaces connected with each other in sequence. Each curved surface includes a slope portion 272, a vertical portion 273, and a transition fillet portion 274 arranged therebetween. The driven tooth 261 has curved surfaces which are set in a conjugate form relative to the curved surfaces of the driving tooth 271.

Figure 5:
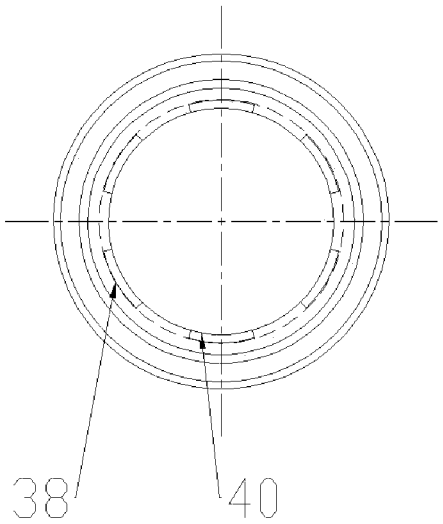
FIG. 5 shows a left view of an embodiment of a lower outer cylinder of the drilling tool of FIG. 1.
Figure 6:
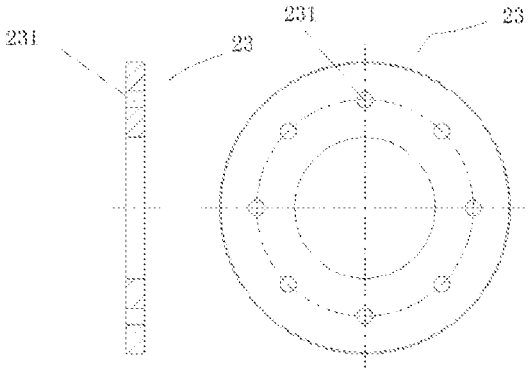
FIG. 6 shows an embodiment of a washer of the drilling tool of FIG. 1.

In addition, the outer wall of the cam hammer 26 is provided with a plurality of first spline teeth 39 protruding out therefrom. In a specific case, a plurality, say six, of the first spline teeth 39 distributed evenly at intervals are provided in the circumferential direction. As shown in FIG. 5, a plurality of first spline slots 38 is provided on the inner wall of the outer cylinder 1, so as to be in engagement with the first spline teeth 39. During the process of driving the cam hammer 26 by the cam anvil 27, the cam hammer 26 can only move axially but not rotate because of the engagement between the first spline slots 38 and the first spline teeth 39. Therefore, when the output main shaft 22 drives the cam anvil 27 to rotate together, the driven tooth 261 will ascend along the slope portion 272, so that the cam hammer 26 will be pushed up. After the cam hammer 26 reaches its highest point as the cam anvil 27 rotates, the driven tooth 261 will fall down along the vertical portion 273 under its own weight, so that the cam hammer 26 moves toward the cam anvil 27 in an axially downward direction.

Also, in the axial direction, an elastic member 24 is arranged between the lower end face of the transmission shaft 20 and the cam hammer 26. When the cam hammer 26 moves axially upward, the elastic member 24 will be compressed; and when the cam hammer 26 moves downward, the compressed elastic member 24 will release its energy to exert the energy on the cam anvil 27 through the cam hammer 26. Since the cam anvil 27 is engaged with the output main shaft 22 through a position-limiting connection, the energy will be transmitted to the output main shaft 22, thereby generating high-frequency reciprocating impact on the drilling bit 50.

It should note that the elastic member 24 may be, for example, a coil spring, a disc spring, or the like. Considering the bearing capacity and the service life of the elastic member 24, the elastic member 24 is preferably a disc spring. In use, parameters of the disc spring, such as preload force, fatigue life or the like, can be designed according to Mubea. Disc Spring Standard.

In a preferred embodiment, washers 23 are respectively fixed at an axially upper end and an axially lower end of the elastic member 24, and arranged around the outer wall of the output main shaft 22. With the washers 23, wear between the elastic member 24 and other members can be avoided. As shown in 6, each washer 23 is provided with multiple through holes 231 axially passing therethrough, the centers of which are located in a first annular line of said washer 23. For example, the first annular line may be located approximately in the radial middle of the washer 23; that is, it is equidistantly spaced from an inner wall surface and an outer wall surface of the washer 23. Also, in the circumferential direction, a plurality, say eight, of through holes 231 may be provided in a manner of being evenly distributed and spaced apart from each other in the circumferential direction. During the compression and the release of the elastic member 24, these through holes 231 can effectively avoid the water hammer pressure, and ensure structural integrity of the elastic member 24 and its neighboring members, thereby facilitating to prolong the service life of the drilling tool 100.

As shown in FIG. 1, it should note that according to the needs of production and assembly, the outer cylinder 1 may consist of several parts. In the present invention, the outer cylinder 1 may include an upper joint 1', an upper outer cylinder 19 and a lower outer cylinder 25, which are fixed with each other (e.g., with threads) in this order from top to bottom. The upper joint 1' is mainly used for connection, and can be connected with other members, such as a drill pipe. The upper outer cylinder 19 is disposed generally outside a turbine power unit and a bearing pack 16 (described in detail below), while the lower outer cylinder 25 is disposed generally outside the output main shaft 22. During production and assembly, the upper outer cylinder 19 constitutes a sub with the components arranged therein, and is connected with another sub constituted by the lower outer cylinder 25 and the components arranged therein.

Figure 9:
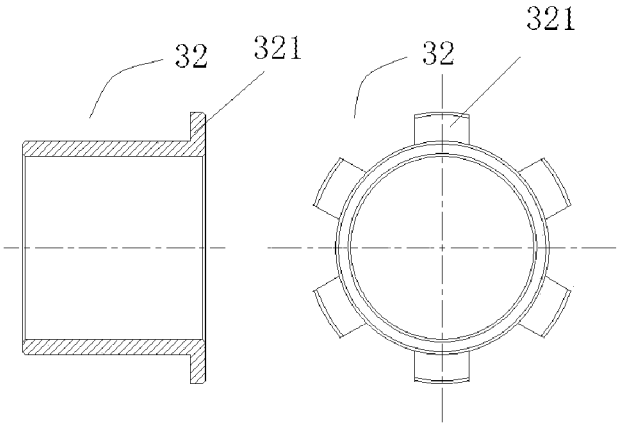
FIG. 9 shows an embodiment of a third wear-resistant static sleeve of the drilling tool of FIG. 1.

As shown in FIG. 1, a wear-resistant joint 31 is provided at the lower end of the outer cylinder 1. The wear-resistant joint 31 per se is cylindrical, and has an upper end partially inserted into the inner chamber of the outer cylinder 1 at the lower end thereof. The lower end of the output main shaft 22 can axially extend out of the wear-resistant joint 31. The wear-resistant joint 31 can prevent the lower end of the output main shaft 22 from being further retracted into the inner chamber of the outer cylinder 1. In order to improve the wear resistance between the wear-resistant joint 31 and the output main shaft 22 for prolonging the service life of the drilling tool 100, a wear-resistant assembly is provided between the wear-resistant joint 31 and the output main shaft 22. For example, a third wear-resistant movable sleeve 33 is fixed on the outer wall of the output main shaft 22. At the same time, a third wear-resistant static sleeve 32 is arranged in the inner wall of the wear-resistant joint 31. For example, as shown in FIG. 9, the wear-resistant joint 31 and the third wear-resistant static sleeve 32 can be in engagement with each other through keys. A lower end of the third wear-resistant static sleeve 32 has several protruding portions 321, which radially extend beyond the lower end face of the wear-resistant joint 31. Preferably, a PDC cemented carbide block is embedded between contact surfaces of the third wear-resistant movable sleeve 33 and the third wear-resistant static sleeve 32; alternatively, the contact surfaces of the third wear-resistant movable sleeve 33 and the third wear-resistant static sleeve 32 are compounded with S201 material. During the rotation of the output main shaft 22 relative to the wear-resistant joint 31, the above arrangement avoids wear occurred therebetween, which facilitates to improve the service life of the drilling tool 100.

A retaining ring assembly is arranged around the outer wall of the output main shaft 22. The retaining ring assembly is located below the cam anvil 27, and can form a locking connection with the wear-resistant joint 31, thereby preventing the output main shaft 22 from moving further downward relative to the transmission shaft 20. Specifically, the retaining ring assembly includes an upper retaining ring 28, a lower retaining ring 30, and balls 29. The upper retaining ring 28 is fixedly arranged on the outer wall of the output main shaft 22. Of course, for the sake of convenient connection, the upper retaining ring 28 can also be screwed on the outer wall of the cam anvil 27. The upper retaining ring 28 and the cam anvil 27 are partially overlapped with each other, and each provided a step surface for engagement with each other. The lower retaining ring is arranged around the outer wall of the output main shaft 22. At the same time, the output main shaft 22 is provided with a first step surface 221, so that a radial size of the output main shaft 22 in a region above the first step surface 221 is reduced. In the axial direction, the upper end of the lower retaining ring 30 abut against the upper retaining ring 28, while an inner wall of the lower end thereof forms a locking connection with the first step surface 221. The outer wall of the lower retaining ring 30 is provided with a third step surface 301, so that an outer diameter of the lower retaining ring 30 below the third step surface 301 is reduced. Balls 29 are disposed between the upper and lower retaining rings 28, 30. During tripping operations, the output main shaft 22 drives the cam anvil 27 and the retaining ring assembly to move downward relative to the transmission shaft 20, until the third step surface 301 is seated on the upper end face of the wear-resistant joint 31. That is, the upper end face of the wear-resistant joint 31 form a locking connection with the third step surface 301, thus realizing an anti-drop effect. In addition, during tripping operations, the upper retaining ring 28 rotates along with the output main shaft 22 and relative to the lower retaining ring 30 and the wear-resistant joint 31. In addition, with the balls 29, the sliding friction between the upper retaining ring 28 and the lower retaining ring 30 is changed into rolling friction, which makes tripping operations easier, reduces the wear between the upper and lower retaining rings 28, 30, and prolongs the service life.

A boss 40 protruding radially inward is provided on the inner wall of the lower outer cylinder 25. The boss 40 is located at the lower end of the first spline slot 38 and can be in engagement with the first spline tooth 39. Specifically, during tripping operations, the cam hammer 26 moves down and seats on the boss 40. That is, the boss 40 serves to prevent the cam hammer 26 from dropping off.

After the cam hammer 26 reaches its top dead point, a distance between the lower end face of the first spline tooth 39 on the cam hammer 26 and the upper end face of the inner annular boss 40 of the lower outer cylinder 25 is L1. At this time, a distance between the lowest point of the movement trajectory of the cam hammer 26 and that of the movement trajectory of the cam anvil 27 is L2. A distance between the third step surface 301 of the lower retaining ring 30 and the upper end face of the wear-resistant joint 31 is L3. In order to ensure normal operation of the drilling tool 100, it should ensure that L3>L1>L2. During the normal operation of the drilling tool 100, since L1>L2, the boss 40 cannot function to restrict the cam hammer 26, thus ensuring that the cam anvil 27 and the cam hammer 26 can cooperate normally. During tripping operations, the cam hammer 26 moves down on the boss 40, and the cam anvil 27 moves down on the wear-resistant joint 31 through the lower retaining ring 30. Since L3>L1, the cam hammer 26 and the cam anvil 27 are out of contact with each other, so as to prevent the driven tooth 261 from impacting on the driving tooth 271 thus ensuring the safety of the drilling tool 100.

In one embodiment, a turbine power unit is arranged in the inner chamber of the outer cylinder 1 and located above the percussion generator in the axial direction, in order to drive the power rotary shaft 13 in rotation to provide rotational energy for the drilling bit 50. That is, according to the present invention, the rotational force of the drilling bit can be generated through the turbine power unit. Specifically, the turbine power unit is arranged in the inner chamber of the upper outer cylinder 19.

The turbine power unit includes a turbine assembly and a flow passage hole 35. The turbine assembly is provided in an annulus between the power rotary shaft 13 and the outer cylinder 1. The turbine assembly includes a stator 10 fixedly connected with the outer cylinder 1, and a rotor 9 connected with the power rotary shaft 13 and matched with the stator 10. When fluid enters the annulus between the outer cylinder 1 and the power rotary shaft 13, the rotor 9 is driven to rotate, thereby driving the power rotary shaft 13 to rotate around its axis. The flow passage hole 35 is provided in the wall of the power rotary shaft 13, for communicating the inside and outside of the power rotary shaft 13. After the fluid is discharged from the lower end of the turbine assembly, it enters the inner chamber of the power rotary shaft 13 through the flow passage hole 35, and then further flows downward through the transmission shaft 20 and the output main shaft 22.

Preferably, in a direction from the outside to the inside, the flow passage hole 35 is arranged obliquely downward. That is, an inlet end of the flow passage hole is located above a discharge end thereof. Further preferably, an angle formed between the inclined direction of the flow passage hole 35 and the axial direction is 35-50 degrees. This arrangement allows for better collection of fluid passing through the turbine assembly.

Figure 2:
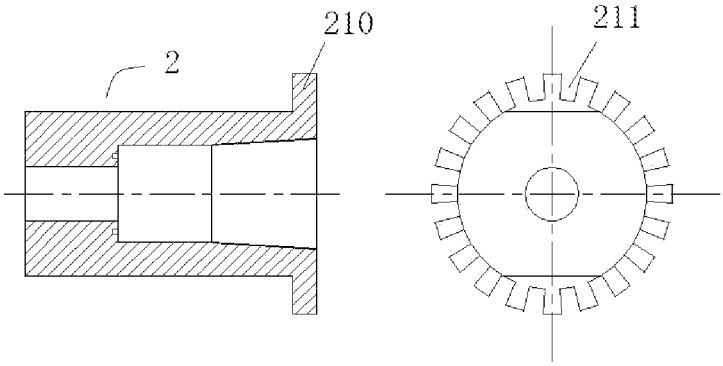
FIG. 2 shows an embodiment of a pressing cap of the drilling tool of FIG. 1.

In one embodiment, the upper end of the power rotary shaft 13 is provided with a nozzle 4 in communication with the power rotary shaft 13. The nozzle 4 is restricted by a pressing cap 2 which is fixedly arranged on the power rotary shaft 13. After fluid enters the inner chamber of the outer cylinder 1, the nozzle 4 can adjusted the amount of the fluid entering into the inner chamber of the power rotary shaft 13, thereby adjusting the amount of the fluid entering the annulus formed between the outer cylinder 1 and the power rotary shaft 13. In addition, a pressing cap rim 210 radially abutting against the inner wall of the outer cylinder 1 is provided on the pressing cap 2, as shown in FIG. 2. The pressing cap brim 210 is provided with flow regulating holes 211 in communication with the annulus formed between the outer cylinder 1 and the power rotary shaft 13. On the one hand, the pressing cap rim 210 is in contact with the inner wall of the outer cylinder 1, thus preventing the turbine assembly from dropping off and also providing centering effect on the power rotary shaft 13. On the other hand, by adjusting the sizes of the flow regulating holes 211, the flow rate of the fluid entering the annulus formed between the outer cylinder 1 and the power rotary shaft 13 can be adjusted, thus further controlling the flow rate and the rotational speed of the turbine. Preferably, a flow channel 34 of the inner chamber of the nozzle 4 is formed as a Vidosinsky curve, which has excellent flow field dynamic characteristic parameters and relatively low flow resistance, which facilitate to improve the adjustment ability of the nozzle 4. The adjustable turbine assembly features a high turbine speed. In terms of structure, the drilling tool 100 has a sub including the turbine power unit and a sub including the percussion generator. Driven by the power rotary shaft 13 and impacted by the percussion assembly, the output main shaft 22 can be subjected to an axially reciprocating impact, which is transmitted to the drilling bit 50 so that the drilling bit impacts on the formation. Under the action of the flow-adjustable turbine assembly with the characteristics of high turbine speed, the turbine assembly can drive the conjugate cam tooth set to compress the elastic member 24, which will generate high-frequency reciprocating impact to improve the rock breaking efficiency, thus achieving comprehensive functions of adjustable high-power rotary torque, percussive energy and high-speed rotary cutting. This compound action facilitates to break up the formation rapidly, which can increase drilling efficiency and reduce drilling cost.

A sealing ring 3 is provided between an upper end face of the nozzle 4 and the pressing cap 2, for preventing fluid from entering the annulus formed between the outer cylinder 1 and the power rotary shaft 13 through a gap between the pressing cap 2 and the nozzle 4.

Figure 3:
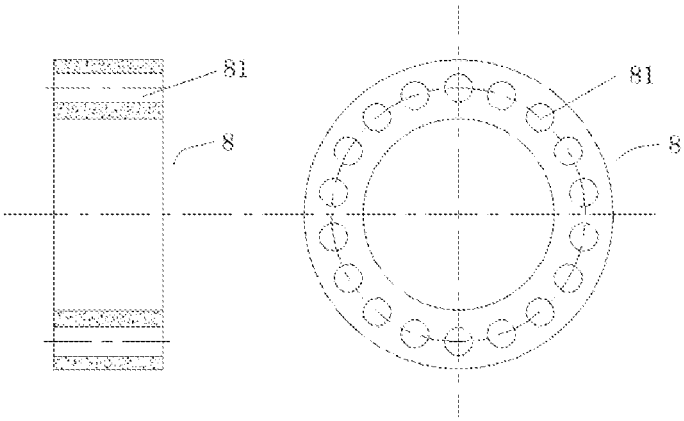
FIG. 3 shows an embodiment of a first flow-rate adjusting and wear-resistant ring of the drilling tool of FIG. 1.

In one embodiment, a first flow-regulating wear-resistant ring 8 is arranged in the annulus formed between the outer cylinder 1 and the power rotary shaft 13. The first flow-regulating wear-resistant ring 8 is located above the turbine assembly, and fixedly connected with the outer cylinder 1. As shown in FIG. 3, the first flow-regulating wear-resistant ring 8 has an annular shape, so that it can be arranged around the outer wall of the power rotary shaft 13. A plurality, say, 16-20, of flow-regulating holes 81 axially passing through the first flow-regulating wear-resistant ring 8 is distributed in the circumferential direction. The flow rate can be adjusted by selecting the size and number of the flow-regulating holes 81. Preferably, the first flow-regulating wear-resistant ring 8 can be made of cemented carbide material 1209. A first wear-resistant movable ring 7 is further arranged between the first flow-regulating wear-resistant ring 8 and the power rotary shaft 13, and fixedly arranged around the outer wall of the power rotary shaft 13. The first wear-resistant movable ring 7 has an outer wall matched with the above-mentioned first flow-regulating wear-resistant ring 8, for protecting the rotating shaft 13 from being worn out during relative rotation. For example, YG8 cemented carbide composite sheet or S201 metallurgical bonding mated al can be embedded between cooperating cylindrical surfaces of the first wear-resistant movable ring 7 and the first flow-adjusting wear-resistant ring 8, in order to enhance wear resistance.

A second flow-regulating wear-resistant ring 12 is arranged in the annulus formed between the outer cylinder 1 and the power rotary shaft 13. The second flow-regulating wear-resistant ring 12 is located below the turbine assembly, and fixedly connected with the outer cylinder 1. The second flow-regulating wear-resistant ring 12 disposed downstream of the turbine assembly is used to adjust the flow rate of the fluid discharged from the turbine assembly, thus ensuring the pressure drop of the fluid passing through the turbine assembly and further ensuring a good operation state of the turbine assembly. The structure and material of the second flow-regulating wear-resistant ring 12 may be the same as or similar to those of the first flow-regulating wear-resistant ring 8. A second wear-resistant movable ring 11 is arranged between the second flow-regulating wear-resistant ring 12 and the power rotary shaft 13, for protecting the rotating shaft 13 from being worn out during relative rotation. Similarly, YG8 cemented carbide composite sheet or S201 metallurgical bonding material can be embedded between cooperating cylindrical surfaces of the second wear-resistant movable ring 11 and the second flow-adjusting wear-resistant ring 12, in order to enhance wear resistance.

The turbine assembly can be positioned by the second flow-regulating wear-resistant ring 12 in the axial direction. Specifically, a fourth step surface 191 facing upward is provided on the inner wall of the upper outer cylinder 19, and a fifth step surface 131 facing upward is provided on the outer wall of the power rotary shaft 13. Upon assembly, a lower end face of the second flow-regulating wear-resistant ring 12 abuts against the fourth step surface 191, while that of the second wear-resistant ring 11 abuts against the fifth step surface 131. Above the turbine assembly, the turbine assembly can be positioned by the first flow adjustment wear-resistant ring 8. Of course, for the convenience of manufacturing and installation, a certain adjusting elements can further be added above the first flow adjustment wear-resistant ring 8. For example, a static pressure ring 6 is provided on the upper end of the first flow-regulating wear-resistant ring 8. Both axial ends of the static pressure ring 6 are respectively in contact with the first flow-regulating wear-resistant ring 8 and the lower end face of the upper joint 1'. A movable pressure ring 5 is arranged on the upper end of the first wear-resistant movable ring 7, and has an axial upper end in contact with the lower end face of the pressing cap 5. The above arrangement ensures the positional relationship between the turbine power unit, the upper outer cylinder 19 and the power rotary shaft 13, resulting in a simple structure and achieving a convenient installation.

In one embodiment, the transmission shaft 20 extends axially upward into the inner chamber of the upper outer cylinder 19, and the bearing pack 16 is arranged between the outer cylinder 1 and the transmission shaft 20. Upon assembly, the inner ring of the bearing pack 16 is fixed to the transmission shaft 20, while the outer ring thereof is fixed to the outer cylinder 1. With the bearing pack 16, it can ensure the rotation and torque transmission between the transmission shaft 20 and the outer cylinder 1. It should note that in order to optimize the structure, the bearing pack 16 can be arranged in the same sub as the turbine assembly.

A limiting assembly for restricting the position of the bearing pack 16 is provided at each of axial ends of the bearing pack 16. Specifically, at an upper end of the bearing pack 16, a fourth wear-resistant movable sleeve 15, which is fixedly arranged around the outer wall of the transmission shaft 20 (e.g., via threads), abuts with its lower end against the inner ring of the bearing pack 16, and a fourth wear-resistant static sleeve 14 is provided between a sixth step surface 192 arranged on the inner wall of the upper outer cylinder 19 and the upper end face of the outer ring of the bearing pack 16. At a lower end of the bearing pack 16, a fifth wear-resistant movable sleeve 17 is located between a seventh step surface 202 arranged on the outer wall of the transmission shaft 20 and the lower end face of the inner ring of the bearing pack 16, and a fifth wear-resistant static sleeve 18 is arranged between the upper end face of the lower outer cylinder 25 and the lower end face of the outer ring of the bearing pack 16. The mating cylindrical surfaces between the fourth wear-resistant movable sleeve 15 and the fourth wear-resistant static sleeve 14 and those between the fifth wear-resistant movable sleeve 17 and the fifth wear-resistant static sleeve 18 are all embedded with YG8 cemented carbide composite sheet or S201 metallurgical bonding material. With the above arrangement, the axial position of the bearing pack can be restricted in a simple and easy-to-implement way.

It should note that during assembly, in an initial state, a distance equivalent to the rated play of the bearing pack 16 is left between the lower end face of the transmission shaft 20 and an upper one of the washers 23. Only after the bearing pack 16 moves with a certain displacement, the lower end face of the transmission shaft 20 will press against the upper one of the washers 23. In order to ensure that elasticity of the elastic member 24 can be utilized at the beginning, a pressing sleeve 21 is arranged outside of the transmission shaft 20 with a gap. In the initial state, both axial ends of the pressing sleeve 21 are in contact with the fifth wear-resistant static sleeve 18 and the upper one of the washers 23, respectively.

During the drilling operation, the WOB is transferred to the transmission shaft 22 through the upper joint 1, the upper outer cylinder 19, and a transmission shaft assembly (including the fourth wear-resistant static sleeve 14, the fourth wear-resistant movable sleeve 15, the bearing pack 16, the fifth wear-resistant movable sleeve 17 and the fifth wear-resistant movable sleeve 18), and then transmitted to the drilling bit 50 through the output main shaft 22. Therefore, no transmission of the WOB is necessary for the above turbine assembly during operation, so that the service life of the turbine assembly is effectively guaranteed.

In the present invention, the power rotary shaft 13 is provided therein with an axial through hole, which serves as a discharging channel for drilling fluid. The power rotary shaft 13 cooperates at its upper portion with the pressing cap 2 through threads, and axially presses the flow-regulating nozzle 4 and thus the rubber sealing ring 3 tight. The diameter of a middle portion of the power rotary shaft 13 is larger than that of the upper portion thereof, and along a direction from top to bottom, the movable-ring pressing ring 5, the static-ring pressing ring 6, the first wear-resistant movable ling 7, the first flow-adjusting wear-resistant ring 8, the rotor 9 and the stator 10 for driving the turbine assembly, the second wear-resistant movable ring 11 and the second flow-regulating wear-resistant ring 12 are arranged around the power rotary shaft 13 in this order. The diameter of a lower portion of the power rotary shaft 13 is larger than that of the middle portion thereof, and the flow passage hole 35 communicating the inside with the outside is located in the lower portion. The lower end face of the power rotary shaft 13 forms a toothed structure with the transmission shaft 20. The power rotary shaft 13 as mentioned above ensures its function with an optimized structure.

Moreover, along the direction from top to bottom, the outer wall of the output main shaft 22 is formed with multiple steps, which have gradually increased diameters. An upper portion of a first cylindrical section of the output main shaft 22 is engaged with the transmission shaft 20 through splines. Below the splined section engaged with the transmission shaft 20, the outer wall of the output main shaft 22 is increased in size, and the upper washer 23, the elastic member 24, the lower washer 23, the cam hammer 26, the cam anvil 27, the upper retaining ring 28, the balls 29 and the lower retaining ring 30 are arranged around the first cylindrical section in this order, and said section is provided with coarse pitch thread to connect with the cam anvil 27, which is provided on its outer wall with fine pitch thread to connect with the lower retaining ring 30. During assembly, the cam anvil 27 is tightened on the output main shaft 22 through the coarse pitch thread, so that an inner side of the cam anvil 27 can tightly press on the step surface of the output main shaft 22. Then, through adjusting the screw depth of the fine pitch thread between the cam anvil 27 and the upper retaining ring 28, the upper retaining ring 28, the balls 29 and the lower retaining ring 30 can be pressed together against a first step surface 221 of the output main shaft 22. The thus-configured output main shaft 22 has a compact structure for realizing power transmission.

The specific working process of the above drilling tool 100 is as follows.

First, the drilling tool 100 described above is lowered into the well to be drilled. During this process, the output main shaft 22, the cam anvil 27 and the retaining ring assembly move downward together to sit on the upper end face of the wear-resistant joint 31, while the cam hammer 26 falls onto the boss 40.

When the drilling bit 50 of the drilling tool 100 touches the bottom of the well, the drilling tool 100 is further lowered to apply the WOB, so that the output main shaft 22 drives the cam anvil 27 and the retaining ring assembly to move axially upward relative to the outer cylinder 1, until the cam hammer 26 cooperates with the cam anvil 27.

Then, drilling operation may start. Fluid is pumped into the drilling tool 100, and enters the annulus between the power rotary shaft 13 and the outer cylinder 1 to drive the rotor 9 of the turbine assembly in rotation. The rotor 9 drives the power rotary shaft 13 to rotate, and drives, in turn, the transmission shaft 20 and the output main shaft 22 to rotate, thus providing rotational power to the drilling bit 50 disposed downstream of the output main shaft 22. At the same time, the rotating output main shaft 22 drives the cam anvil 27 to rotate together, while the cam anvil 27 axially lifts the cam hammer 26 to compress the elastic member 24. Under the elastic force of the elastic member 24 and the self-weight of the cam hammer 26, the cam hammer 26 applies axial impact on the cam anvil 27. The axial reciprocating impact acts on the output main shaft 22, and is finally transmitted to the drilling bit 50. As a result, when the drilling bit 50 rotates, reciprocating impact can be generated to improve rock-breaking efficiency, which provides new technical means for efficient drilling in hard and complex formations for ultra-deep oil wells, geothermal wells, and dry-hot rock wells.

Although the present invention has been described with reference to the preferred embodiments, various modifications may be made and equivalents may be substituted for components thereof without departing from the scope of the present invention. In particular, under the condition that there is no structural conflict, each technical feature mentioned in each embodiment can be combined in any manner. The present invention is not limited to the specific embodiments disclosed herein, but includes all technical solutions falling within the scope of the claims.

The invention claimed is:

1. A drilling tool, comprising:

an outer cylinder;

a power rotary shaft arranged in an inner chamber of the outer cylinder and configured to be driven to rotate around an axis of the power rotary shaft;

a percussion generator arranged below the power rotary shaft, comprising:

a transmission shaft extending in the outer cylinder, and configured to be coupled with and driven by the power rotary shaft to rotate around an axis of the transmission shaft;

an output main shaft, which has an upper end engaged with a lower end of the transmission shaft so as to be driven by the transmission shaft to rotate about an axis of the output main shaft, and is movable relative to the transmission shaft along an axial direction; and an percussion assembly, which is arranged between an annulus formed between the upper end of the output main shaft and the outer cylinder, and is configured to generate reciprocating impact along the axial direction on the output main shaft; and a drilling bit connected with a lower end of the output main shaft extending out of the inner chamber of the outer cylinder, wherein the percussion assembly comprises:

a cam anvil fixedly arranged around an outer wall of the output main shaft;

a cam hammer arranged around the outer wall of the output main shaft, a lower end of the cam hammer being formed with a driven tooth, which forms a conjugate set of cam teeth with a driving tooth formed on the cam anvil; and an elastic member arranged in an annulus formed between the output main shaft and the outer cylinder and axially located between an upper end face of the cam hammer and a lower end face of the transmission shaft, wherein during rotation of the cam anvil around an axis of the cam anvil, the driving tooth acts on the driven tooth to enable the cam hammer to move reciprocally in the axial direction and acts on the elastic member, so that the elastic member acts on the cam hammer and the cam anvil in sequence, causing the output main shaft to generate axial reciprocating impact, a wear-resistant joint is fixedly arranged at the lower end of the outer cylinder, and is in clearance fit with the output main shaft, a retaining ring assembly is arranged around the outer wall of the output main shaft, and located below the cam anvil, wherein the retaining ring assembly is configured to be in engagement with the wear-resistant joint, so as to prevent the cam anvil and the output main shaft from moving further downward relative to the transmission shaft, wherein the retaining ring assembly comprises:

an upper retaining ring fixedly arranged around the outer wall of the output main shaft and located below the cam anvil;

a lower retaining ring arranged around the outer wall of the output main shaft, the lower retaining ring having an upper end face opposite to the upper retaining ring, and forming a locking connection between an inner wall of the lower retaining ring at a lower end thereof and a first step surface arranged on the output main shaft; and balls arranged between opposing surfaces of the upper and lower retaining rings.

2. The drilling tool according to claim 1, wherein a washer is provided at each axial end of the elastic member, and includes a plurality of through holes evenly distributed in a circumferential direction on a first annular line of the washer, the through holes axially passing through the washer.

3. The drilling tool according to claim 2, wherein a turbine power unit for driving the power rotary shaft to rotate around an axis of the turbine power unit is arranged in the inner chamber of the outer cylinder, and comprises:

a turbine assembly disposed in an annulus formed between the power rotary shaft and the outer cylinder, the turbine assembly having a stator fixedly connected to the outer cylinder, and a rotor fixedly connected to the power rotary shaft; and a flow passage hole arranged on the power rotary shaft and passing therethrough, wherein fluid injected into the annulus formed between the power rotary shaft and the outer cylinder drives the turbine assembly so that the rotor of the turbine assembly drives the power rotary shaft to rotate around the axis of the power rotary shaft, and then passes through the flow passage hole to enter into the inner chamber of the power rotary shaft, and flows downward through the transmission shaft and the output main shaft.

4. The drilling tool according to claim 2, wherein a bearing pack is provided between the outer cylinder and the transmission shaft, an inner ring of the bearing pack being fixed to the transmission shaft and an outer ring thereof being fixed to the outer cylinder.

5. The drilling tool according to claim 1, wherein the output main shaft and the transmission shaft are connected with each other by splines.

6. The drilling tool according to claim 5, wherein a bearing pack is provided between the outer cylinder and the transmission shaft, an inner ring of the bearing pack being fixed to the transmission shaft and an outer ring thereof being fixed to the outer cylinder.

7. The drilling tool according to claim 1, wherein an outer wall of the cam hammer is provided with first spline teeth protruding therefrom, and an inner wall of the outer cylinder is provided with first spline slots engageable with the first spline teeth; and a boss protruding radially inward is provided on the inner wall of the outer cylinder below the first spline slots, forming a snap fit with the first spline teeth.

8. The drilling tool according to claim 7, wherein a bearing pack is provided between the outer cylinder and the transmission shaft, an inner ring of the bearing pack being fixed to the transmission shaft and an outer ring thereof being fixed to the outer cylinder.

9. The drilling tool according to claim 1, wherein a turbine power unit for driving the power rotary shaft to rotate around an axis of the turbine power unit is arranged in the inner chamber of the outer cylinder, and comprises:

a turbine assembly disposed in an annulus formed between the power rotary shaft and the outer cylinder, the turbine assembly having a stator fixedly connected to the outer cylinder, and a rotor fixedly connected to the power rotary shaft; and a flow passage hole arranged on the power rotary shaft and passing therethrough, wherein fluid injected into the annulus formed between the power rotary shaft and the outer cylinder drives the turbine assembly so that the rotor of the turbine assembly drives the power rotary shaft to rotate around the axis of the power rotary shaft, and then passes through the flow passage hole to enter into the inner chamber of the power rotary shaft, and flows downward through the transmission shaft and the output main shaft.

10. The drilling tool according to claim 9, wherein a nozzle in communication with the power rotary shaft is provided at an upper end of the power rotary shaft, and restricted by a pressing cap fixed on the power rotary shaft;

an outer wall of the pressing cap is provided with a cap rim, which abuts against the inner wall of the outer cylinder in a radial direction, and is provided with a flow-regulating hole axially passing through the cap rim.

11. The drilling tool according to claim 10, wherein a first flow-regulating wear-resistant ring located above the turbine assembly is arranged in the annulus between the power rotary shaft and the outer cylinder.

12. The drilling tool according to claim 10, wherein a second flow-regulating wear-resistant ring located below the turbine assembly is arranged in the annulus between the power rotary shaft and the outer cylinder.

13. The drilling tool according to claim 10, wherein a bearing pack is provided between the outer cylinder and the transmission shaft, an inner ring of the bearing pack being fixed to the transmission shaft and an outer ring thereof being fixed to the outer cylinder.

14. The drilling tool according to claim 9, wherein a bearing pack is provided between the outer cylinder and the transmission shaft, an inner ring of the bearing pack being fixed to the transmission shaft and an outer ring thereof being fixed to the outer cylinder.

15. The drilling tool according to claim 1, wherein a turbine power unit for driving the power rotary shaft to rotate around an axis of the turbine power unit is arranged in the inner chamber of the outer cylinder, and comprises:

a turbine assembly disposed in an annulus formed between the power rotary shaft and the outer cylinder, the turbine assembly having a stator fixedly connected to the outer cylinder, and a rotor fixedly connected to the power rotary shaft; and a flow passage hole arranged on the power rotary shaft and passing therethrough, wherein fluid injected into the annulus formed between the power rotary shaft and the outer cylinder drives the turbine assembly so that the rotor of the turbine assembly drives the power rotary shaft to rotate around the axis of the power rotary shaft, and then passes through the flow passage hole to enter into the inner chamber of the power rotary shaft, and flows downward through the transmission shaft and the output main shaft.

16. The drilling tool according to claim 1, wherein a bearing pack is provided between the outer cylinder and the transmission shaft, an inner ring of the bearing pack being fixed to the transmission shaft and an outer ring thereof being fixed to the outer cylinder.

17. The drilling tool according to claim 1, wherein a bearing pack is provided between the outer cylinder and the transmission shaft, an inner ring of the bearing pack being fixed to the transmission shaft and an outer ring thereof being fixed to the outer cylinder.

18. The drilling tool according to claim 1, wherein a bearing pack is provided between the outer cylinder and the transmission shaft, an inner ring of the bearing pack being fixed to the transmission shaft and an outer ring thereof being fixed to the outer cylinder.

* * * * *